US005235914A

United States Patent [19]

Williams et al.

[11] Patent Number: 5,235,914

[45] Date of Patent: * Aug. 17, 1993

[54] APPARATUS AND METHOD FOR IMAGING LITHOGRAPHIC PRINTING PLATES USING SPARK DISCHARGES

[75] Inventors: Richard A. Williams, Hampstead; Thomas E. Lewis, E. Hampstead; John F. Kline; John P. Gardiner, both of Londonderry, all of N.H.

[73] Assignee: Presstek, Inc., Hudson, N.H.

[ * ] Notice: The portion of the term of this patent subsequent to Mar. 27, 2007 has been disclaimed.

[21] Appl. No.: 837,055

[22] Filed: Feb. 18, 1992

Related U.S. Application Data

[60] Division of Ser. No. 639,254, Jan. 9, 1991, Pat. No. 5,163,368, which is a continuation-in-part of Ser. No. 413,172, Sep. 27, 1989, Pat. No. 5,005,479, which is a continuation-in-part of Ser. No. 234,475, Aug. 19, 1988, Pat. No. 4,911,075.

[51] Int. Cl.[5] ..... B41C 1/05; B41C 1/10; B41N 1/14

[52] U.S. Cl. ..... 101/467; 101/453; 101/458

[58] Field of Search ..... 101/453, 454, 458, 459, 101/467

[56] References Cited

U.S. PATENT DOCUMENTS

| | | | |
|---|---|---|---|
| 3,745,235 | 7/1973 | Bestenreiner et al. | 178/5.2 R |
| 3,945,318 | 3/1976 | Landsman | 101/467 |
| 3,978,492 | 8/1976 | Simm | 346/74 J |
| 4,054,094 | 10/1977 | Caddell et al. | 101/467 |
| 4,082,902 | 4/1978 | Suzuki et al. | 101/467 X |
| 4,292,397 | 9/1981 | Takeuchi et al. | 101/466 |
| 4,347,785 | 9/1982 | Chase et al. | 101/1 |
| 4,395,946 | 8/1983 | Price | 101/152 |
| 4,459,604 | 7/1984 | Kudelski | 346/135.1 |
| 4,463,363 | 7/1984 | Gundlach et al. | 346/159 |
| 4,492,750 | 1/1985 | Law et al. | 430/494 |
| 4,530,285 | 7/1985 | Fischer | 101/365 |
| 4,584,592 | 4/1986 | Tuan et al. | 346/159 |
| 4,628,813 | 12/1986 | Hasegawa et al. | 101/116 |
| 4,718,340 | 1/1988 | Love, III | 101/467 |
| 4,724,446 | 2/1988 | Hirahara et al. | 346/76 PH |
| 4,727,388 | 2/1988 | Sheridon et al. | 346/159 |
| 4,729,310 | 3/1988 | Love, III | 101/466 X |
| 4,814,797 | 3/1989 | Haneda et al. | 346/157 |
| 4,833,486 | 5/1989 | Zerillo | 346/1.1 |
| 4,852,485 | 8/1989 | Brunner | 101/DIG. 45 |
| 4,884,080 | 11/1989 | Hirahara et al. | 346/46 |
| 4,911,075 | 3/1990 | Lewis et al. | 101/453 |
| 5,062,364 | 11/1991 | Lewis et al. | 101/467 |

FOREIGN PATENT DOCUMENTS

| | | | |
|---|---|---|---|
| 0130028 | 1/1985 | European Pat. Off. | 101/467 |
| 0167352 | 6/1985 | European Pat. Off. | 101/467 |
| 1041217 | 10/1953 | France . | |
| 3-197190 | 8/1991 | Japan . | |
| 3-197191 | 8/1991 | Japan . | |
| 3-197192 | 8/1991 | Japan . | |
| WO9207716 | 5/1992 | PCT Int'l Appl. . | |

OTHER PUBLICATIONS

13 IBM Technical Disclosure Bulletin 33 (Jun. 1970).

*Primary Examiner*—Edgar S. Burr
*Assistant Examiner*—Stephen R. Funk
*Attorney, Agent, or Firm*—Cesari and McKenna

[57] ABSTRACT

Apparatus and method for imaging a lithographic plate having a metal first layer and a second layer underlying the metal layer, the first and second layers exhibiting different affinities for fountain solution and/or ink. Selective removal of the first layer in an imagewise pattern reveals the second layer, resulting in direct production of image spots. The plate is ready for printing at the conclusion of the imaging process.

26 Claims, 3 Drawing Sheets

Figure 1:
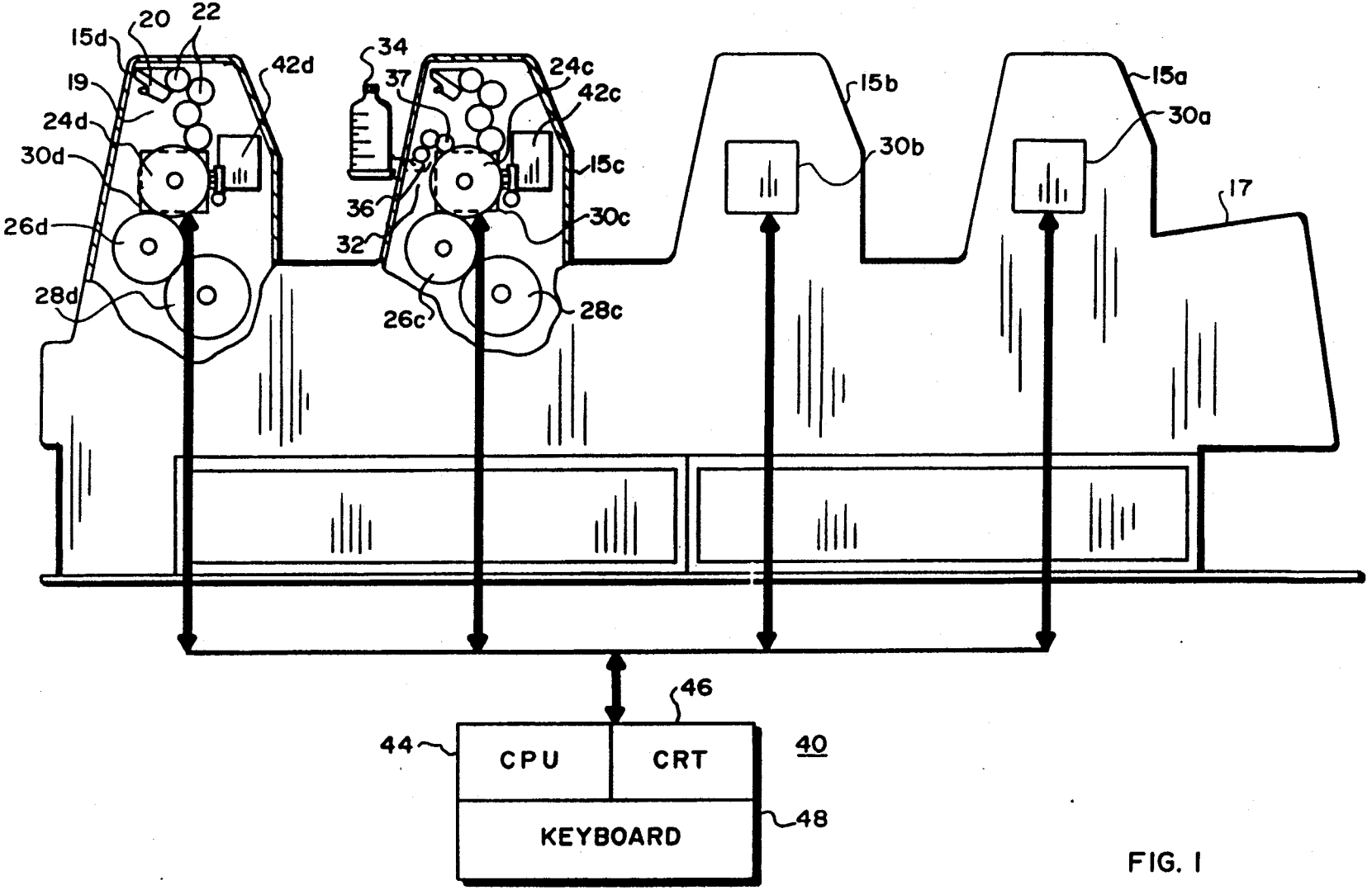

APPARATUS AND METHOD FOR IMAGING LITHOGRAPHIC PRINTING PLATES USING SPARK DISCHARGES

RELATED APPLICATIONS

This is a division of U.S. Ser. No. 07/639,254, filed Jan. 9, 1991, now U.S. Pat. No. 5,163,368, which is itself a continuation-in-part of U.S. Ser. No. 07/413,172, filed Sep. 28, 1989, now U.S. Pat. No. 5,005,479 (the entire contents of which are hereby incorporated by reference), itself a continuation-in-part of U.S. Ser. No. 07/234,475, filed Aug. 19, 1988 now U.S. Pat. No. 4,911,075.

BACKGROUND OF THE INVENTION

A. Field of the Invention

The present invention relates to printing apparatus and methods, more particularly to improved apparatus for printing single- or multiple-color copies using digital spark-discharge recording technology.

B. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing plates, in contrast, contain series of wells or indentations that accept ink for deposit onto the recording medium; excess ink must be removed from the plate by a doctor blade or similar device prior to contact between the plate and the recording medium.

In the case of offset lithography, the image is present on a plate or mat as a pattern of ink-accepting (oleophilic and ink-repellent (oleophobic) surface areas. In a dry printing system, the plate is simply inked and the image transferred onto a recording material; the plate first makes contact with a compliant intermediate surface called a blanket cylinder which, in turn, applies the image to the paper or other copying medium. In typical rotary press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The fountain solution prevents ink from adhering to the non-image areas, but does not affect the oleophilic character of the image areas.

The plates for an offset press are usually produced photographically. In a typical negative-working subtractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), and these non-cured areas become oleophobic and/or hydrophilic.

If a press is to print in more than one color, a separate printing plate corresponding to each color is required, each such plate usually being made photographically as just described. In addition to preparing the appropriate plates for the different colors, the operator must mount the plates properly on the plate cylinders of the press, and coordinate the positions of the cylinders so that the color components printed by the different cylinders will be in register on the printed copies. Each set of cylinders associated with a particular color on a press is usually referred to as a printing station.

In most conventional presses, the printing stations are arranged in a straight or "in-line" configuration. Each such station typically includes an impression cylinder, a blanket cylinder, a plate cylinder and the necessary ink (and, in wet systems, water) assemblies. The recording material is transferred among the print stations sequentially and in register, each station applying a different ink color to the material to produce a composite multicolor image. Another configuration, described in U.S. Pat. No. 4,936,211 (co-owned with the present application and hereby incorporated by reference), relies on a central impression cylinder that carries a sheet of recording material past each print station, eliminating the need for mechanical transfer of the medium to each print station.

With either type of press, the recording medium can be supplied to the print stations in the form of cut sheets or a continuous "web" of material. The number of print stations on a press depends on the type of document to be printed. For mass copying of text or simple monochrome lineart, a single print station may suffice. To achieve full tonal rendition of more complex monochrome images, it is customary to employ a "duotone" approach, in which two stations apply different densities of the same color or shade. Full-color presses apply ink according to a selected color model, the most common being based on cyan, magenta, yellow and black (the "CMYK" model). Accordingly, the CMYK model requires a minimum of four print stations; more may be required if a particular color is to be emphasized. The press may contain another station to apply spot lacquer to various portions of the printed document, and may also feature one or more "perfection" assemblies that invert the recording medium to obtain two-sided printing.

A number of difficulties attend both the platemaking and ink-transfer stages of printing. The photographic process used to produce conventional plates is time-consuming and requires a facility and equipment adequate to support the necessary chemistry. To circumvent this process, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or ink-accepting spots on plate blanks; and spark-discharge equipment, in which an electrode in contact with or spaced close to a plate blank produces electrical sparks to physically alter the topology of the plate blank, thereby producing "dots" which collectively form a desired image.

While these digital platemaking technologies have alleviated many of the disadvantages associated with more traditional approaches they are not free from drawbacks of their own. Such drawbacks are described in U.S. Pat. No. 4,911,075 (co-owned with the present application and hereby incorporated by reference).

Presses must also be provided with mechanical assemblies for maintaining and correcting registration among the images applied by the various print stations. In the case of an in-line press, it is necessary to employ very accurate paper-feeding and paper-transfer mechanisms, as well as precision gearing, to assure consistent positioning among print stations. The press should also allow for correction of misregistrations by adjustment of the relative positions of the plate cylinders to maintain proper rotational, axial and skew-orientation phase; so long as the paper is fed and transferred accurately among print stations, such positioning corrections will correct misregistrations on a consistent basis.

The mechanical difficulties of maintaining registration are ameliorated, but not eliminated, if the plate is to be imaged on-press. In this case, mispositioning due to improper mounting of the finished plate onto the plate cylinder is effectively overcome. However, in a multistation press, it becomes necessary to maintain registration among plate cylinders during both the plate-imaging and printing stages. Specifically, not only must the print stations apply ink in register with one another, but each individual plate-imaging system must be coordinated both with its own plate cylinder (which holds the plate to be imaged) and with one another so as to maintain consistent plate orientations.

The ink flow at each print station must also be accurately regulated, as well as remain adjustable to accommodate different ink densities or produce a desired color correction on the final printed copy. As discussed in U.S. Pat. No. 4,058,058, a press may be equipped with a number of electrically controlled ink-regulating screws or keys distributed across the press to regulate the amount of ink that the ink fountain at each print station applies to the plate cylinder at that station. These regulators may be controlled manually or, to some extent, with the assistance of computer equipment. In some publishing systems, for example, the color separations prepared from each page mock-up are scanned and stored digitally as proofs; hard copy produced by the press is similarly scanned, and digitally compared with the mock-up proofs to determine the necessary ink-regulation adjustments. Thus, at present, an operator must devote time and/or skilled judgment to determine the settings of ink regulators.

DESCRIPTION OF THE INVENTION

A. Brief Summary of the Invention

The invention comprises a number of interrelated and cooperative elements that facilitate electronic imaging, preferably on-press, of one or more lithographic plates, and printing with such plates on various types of presses. The invention includes mechanical and electrical elements that maintain alignment and registration of a plurality of imaged plates, and allow feedback-controlled ink regulation to eliminate, or at least reduce, the necessity of having an operator manually key the ink settings.

Our printing apparatus, which can be configured as an in-line press, a central-impression press or any other workable lithographic press design, is designed to accept electronic signals that represent monochrome or color-separated images to be printed, and use these signals to control an imaging device that creates an image on a plate blank. The plate blank may be mounted and imaged on-press, i.e., on the plate cylinder that will ultimately accept ink and transfer the image to a blanket cylinder, or off-press on a separate imaging assembly. Recording material may be fed to the press as cut sheets or in a web, and may consist of paper, film, metal foil, or a composite of two or more of the foregoing (e.g., film laminated onto paper).

The electronic imaging assembly or assemblies can be based on any of several types of technology, the primary requirement being amenability to digital operation and control. Suitable technologies, all of which are well-characterized in the art, include laser and non-laser pulsed sources of electromagnetic radiation, electron-beam scanning apparatus, ink-jet equipment, and spark-discharge imaging equipment. Each imaging assembly responds to incoming picture signals representing the respective color component of the original document or picture to be printed by the particular printing station.

Our preferred imaging system is a high-voltage, non-contact spark-discharge or plasma-discharge apparatus, as described in U.S. Pat. No. 4,911,075, U.S. Pat. No. 5,062,364 (commonly owned with the present application and hereby incorporated by reference), and a PCT application filed in the U.S. Patent and Trademark Office on Sep. 28, 1990 entitled "Plasma-Jet Imaging Apparatus and Method" and assigned U.S. Ser. No. 90/05546 (also with the present application and hereby incorporated by reference).

The invention addresses registration errors in several ways. On-press imaging itself eliminates registration errors arising from mispositioning of the printing plates on the plate cylinders. The on-press configuration also facilitates correction of periodic registration errors by electronic control of the relative phases of the plate cylinders or the timing of the picture signals applied to the imaging devices, so that the phases of the images are kept identical.

We also employ an electronic controller to automatically set and adjust the ink-regulation mechanism, based on the percentage of coverage for a particular key and/or the output of a flash densitometer. The ink settings provided by the controller can, of course, be overridden manually.

Operation of the apparatus is supervised by a central computer, which can also be programmed to provide such prepress functions as editing and raster-image processing.

B. Brief Description of the Drawings

Figure 2:
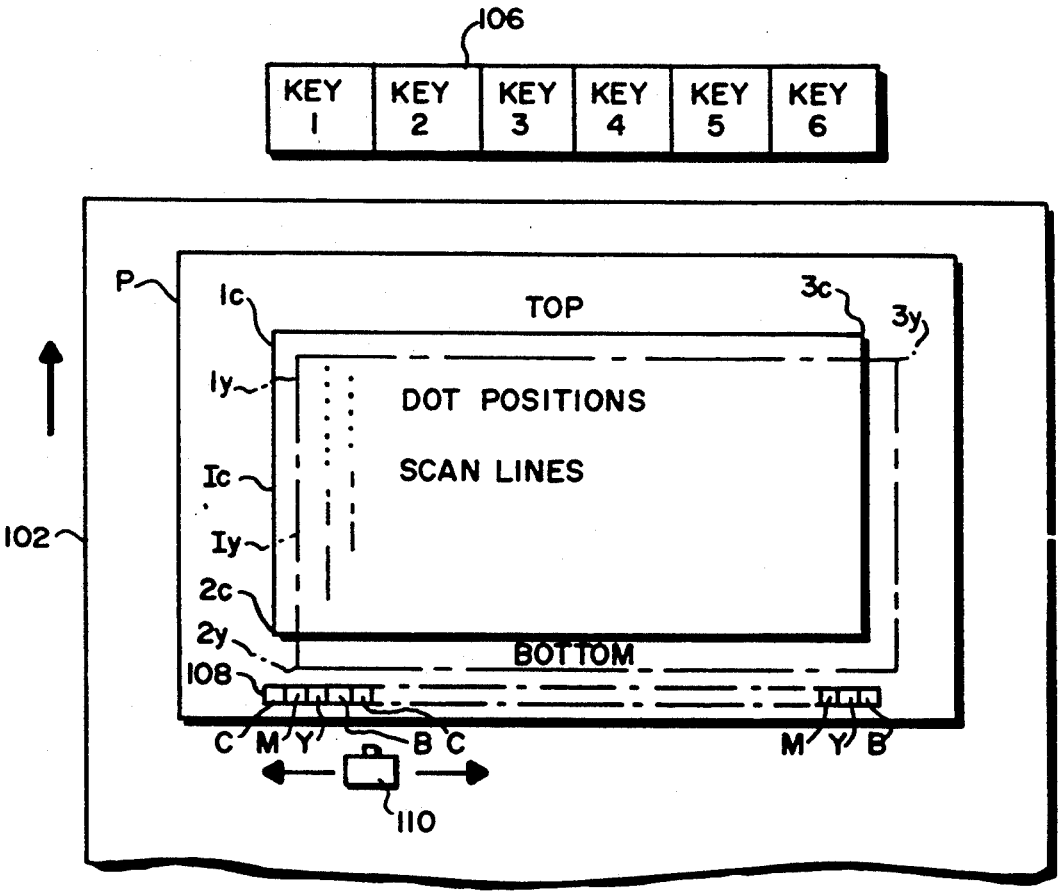
Figure 3:
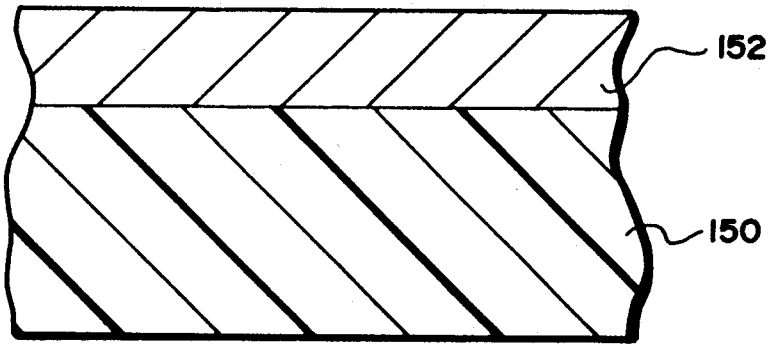

The foregoing discussion will be understood more readily from the following detailed description of the invention, when taken in conjunction with the accompanying drawings, in which:

FIG. 1 is a side elevational and schematic view of an offset color press incorporating the features of our invention; and FIG. 2 is a diagrammatic view of a test print used to align and color-calibrate the press; and FIG. 3 is an enlarged sectional view of a printing plate suitable for use with the present invention.

C. Description of the Preferred Embodiment

1. Press Configurations

For ease of explanation, we will describe an illustrative embodiment of our invention as incorporated into a conventional in-line press. However, it should be understood that the primary features of our invention can also be utilized in conjunction with a central-impression press, as described in U.S. Pat. No. 4,936,211, or any other direct-impression or offset-impression press design.

Refer first to FIG. 1, which is a side elevational view of our in-line-press embodiment with cutaway views of two print towers. The press comprises a series of four print stations or towers 15*a*, 15*b*, 15*c* and 15*d*, each of which contains the necessary equipment (to be described in detail below) to apply ink or lacquer to a recording material. Although four print stations are illustrated, it should be understood that conventional presses can contain as few as one or as many as 10 or more such stations, depending on the nature of the printing to be performed.

Individual sheets of recording material are fed to the print stations from a tray 17 at the right side of the press as viewed in FIG. 1. A conventional handling mechanism (not shown) draws the topmost sheet from tray 17 and carries it to the first print station 15*a*, where it is wrapped around an impression cylinder and inked. Thereafter, the sheet is stripped from this impression cylinder and carried to the second print station 15*b* where a similar operation is performed, and so on. The handling mechanism maintains registration and alignment of the material as it is transported across the press, and may contain a "perfection" assembly that turns the sheet upside down between print stations for two-sided printing.

The cutaway view of FIG. 1 illustrate the components of two representative print stations 15*c*, 15*d*. Station 15*d*, which is configured for dry printing, includes an ink fountain assembly 19 that comprises an ink tray 20, which transfers ink via a series of rollers 22, and means for automatically controlling ink flow so that the amount and distribution of ink can be regulated electronically. The rollers 22 transfer ink to the surface of a plate cylinder 24*d*, which makes surface contact with a blanket cylinder 26*d* of the same diameter, and that cylinder, in turn, is in surface contact with an impression cylinder 28*d*. The print station also includes a controller, shown in phantom at reference numeral 30*d*. which monitors the angular position of plate cylinder 24*d* and also furnishes ink-control signals to ink fountain assembly 19. A suitable controller design is described in U.S. Pat. No. 5,174,205 (the entire disclosure of which is hereby incorporated by reference); however, for purposes hereof, the controller can be any suitable angular positioning and monitoring system.

The press can also be configured to print webs of recording material by addition of suitable feeding equipment on the intake side of the press (in lieu of tray 17), and complementary uptake equipment on the output side.

Print station 15*c* is configured for wet printing; in actual practice, it would be unusual to employ both wet and dry printing stations in the same press, and both types are shown in FIG. 1 for illustrative purposes. Print station 15*c* contains all of the features of print station 15*d*, as well as a dampening system 32, which comprises a water source 34 that feeds water to a water tray 36. A series of dampening rollers 37 transfer water from water tray 36 to plate cylinder 24*c*. For this station, controller 30*c* regulates dispensation both of water and ink.

Preferably, the printing stations are equipped with on-press imaging systems, indicated by reference numerals 42*c* and 42*d*, although not all aspects of the invention require this feature. The imaging system will be described in further detail below.

The press also includes a computer, shown schematically at reference numeral 40, which transfers image data and control signals to controllers 30*a*, 30*b*, 30*c* and 30*d*. Connections between computer 40 and the controllers are provided by suitable cables. The press responds to digital signals, supplied by computer 40, that represent an original document or image.

Computer 40 comprises a central-processing unit (CPU) 44, which stores, retrieves and manipulates data; a cathode-ray tube (CRT) or other suitable display 46 for communication with the operator; and a keyboard 48, with which the operator enters data and control commands. Computer 40 may be a single machine or a set of processors configured to operate in parallel, thereby dividing the workload and increasing the effective processing speed. In a single machine, an equivalent multiprocessor architecture can be produced by increasing the number of central-processing units.

Using keyboard 48, the operator may enter instructions for imaging the printing plates on-press, registration information, and/or instructions relating to press control such as ink-flow adjustment, number of copies to be printed, etc. In addition, as discussed below, computer 40 can be provided with certain "pre-press" functions that permit the operator to process image and text data into output-ready form. CPU 44 may include one or more mass-storage devices, such as disks or tape drives, to hold the typically large quantities of data associated with digitized images.

2. Plates and Plate Imaging

As stated hereinabove, a number of imaging technologies can be adapted for use on-press. Our preferred imaging system is the spark-discharge or plasma-discharge equipment discussed hereinabove, and as more fully described in the patents and patent applications cited previously. Basically, in response to incoming picture signals and ancillary image data supplied by computer 40, high-voltage pulses having precisely controlled voltage and current profiles are applied to one or more electrodes or plasma-jet sources to produce precisely positioned and defined arc or plasma-jet discharges to the plate. These discharges physically transform selected points or areas of the plate surface to render them either receptive or non-receptive to ink and/or water.

The imaging system is preferably implemented as a scanner or plotter whose writing head consists of one or more electrode or plasma-jet sources positioned a small distance above the working surface of the plate and moved relative to the plate so as to collectively scan a raster on the plate surface. To achieve the requisite relative motion between the writing head and the cylindrical plate, the plate can be rotated about its axis and the writing head moved parallel to the rotation axis so that the plate is scanned circumferentially with the image on the plate "growing" in the axial direction. Alternatively, the writing head can move parallel to the cylinder axis and after each pass of the head the cylinder can be incremented angularly so that the image on the plate grows circumferentially. The angular position of the writing head with respect to the plate is monitored by a controller, as discussed above, while a distance-sensing and adjustment mechanism (such as that described in U.S. Pat. No. 5,121,688) controls the distance of the head away from the plate.

The power of the arc actually reaching the plate (i.e., its voltage/current profile) depends on the inherent breakdown voltage associated with the ambient air or applied working gas, the voltage (positive or negative) of the pulse applied to the electrode or plasma-jet source, and the rise time of this pulse. The interplay of these variables derives from the fact that breakdown and arcing are not an instantaneous process. Although the drop in resistance that accompanies breakdown would ordinarily prevent maintenance of voltages above the breakdown threshold, a very fast rise time can momentarily impose voltage levels across the gap that exceed this threshold during the finite time required for breakdown to occur.

The current range, on the other hand, depends both on this effective arc voltage and the design of the pulse circuitry. Furthermore, the electrical properties of the plate can limit the maximum useful current, since insufficient conductivity (e.g., due to use of too thin a layer of material for a given current level) results in charge buildup that can diminish the strength of the arc or prevent arcing entirely. Our preferred applied voltage levels—that is, the voltage actually supplied to the electrode or plasma-jet source, not the effective arc voltage—range from 1,000 to 5,000 volts; potential levels above 2,000 volts are especially preferred. As stated previously, the effective arc voltage for a given applied voltage depends on the rise time of the voltage pulse and the breakdown voltage of the ambient air or applied working gas. Our preferred working current ranges from 0.1 to 1 amp. Lower current levels tend to be associated with easily ionized gases such as argon, and the higher levels with gases having higher breakdown voltages, such as air.

By varying the applied voltage or current supplied to the electrode, or the duration of its application, or the number of discharges applied at a give location, it is possible to produce image spots of variable sizes. Means for accomplishing this are quite well-known in the art. Likewise, dot size may be varied by repeated pulsing of the electrode at each image point, with final dot size determined by the number of applied pulses (pulse-count modulation).

Our preferred plate constructions, designed for use with this type of imaging equipment, are described in U.S. Pat. Nos. 4,911,075, 5,109,771 and 5,052,292. Briefly, these plates contain, at a minimum, a conductive metal layer and a second layer underlying the metal layer, the metal and underlying layers having different affinities for ink and/or water. This construction is shown in FIG. 3, which illustrates a plate having a substrate 150 that underlies a thin metal layer 152 (the precise characteristics of which are fully discussed in the '075 patent). The spark discharges are powerful enough to remove the metal layer and thereby expose the underlying layer at selected points. When the scan is complete, the points collectively form the image to be printed.

In a variation of this construction, suitable for dry printing, the plate contains an oleophobic (e.g. silicone) first layer, a metal second layer underlying this first layer, and an oleophilic third layer underlying the second layer. To image this type of plate, the spark discharges remove both the top and metal layers but leave the bottom layer intact.

Use of a metal imaging layer confers two key advantages. The first is high imaging accuracy. In a non-contact imaging system, reproduction accuracy depends on the ability to prevent the discharge from wandering as it travels from its source to the surface of the plate. This ordinarily requires a high field gradient between the discharge source and the point on the plate that is to be imaged. The strongest part of the field on the plate, to which the discharge is most strongly attracted, occurs at the point precisely opposite the discharge source. However, the strength of the field at this point must be sufficiently greater than the strength at any other point to overcome the inherently random nature of the discharge. The stronger the gradient, the faster the field strength will diminish as the path from source to plate deviates from the normal. Accordingly, high discharge power creates a strong gradient, which in turn favors straight-line discharge travel by emphasizing the recession of the plate field strength in all directions away from the normal.

Second, high-energy discharges permit us to ablate refractory materials. By employing strong surface and substrate layers, we are able to produce lithographic plates that offer longer performance lifetimes than those of the prior art.

3. Press Operation

To operate the press in its imaging mode, the operator first mounts plate blanks on each plate cylinder that will be used for printing the finished document. He or she then inserts a disk, tape, or any form of digital storage medium carrying digital data representing the color separations of the original document to be copied, and loads that data into the internal memory of the computer 40. The operator can call up the data and preview the image on display 46 before printing. Upon operator command, computer 40 transmits picture signals representative of that image data to controllers 30*a*, 30*b*, 30*c* and 30*d*, which are caused to actuate the associated imaging-system writing heads and thereby apply corresponding images to the plates on the respective plate cylinders.

Alternatively, press computer 40 can also be provided with pre-press editing functions, such as raster-image processing, that convert raw image data and text data (the latter typically encoded in page-description language) into the output-ready bitmap that is sent to the controllers as picture signals. This capability introduces nearly all of the production steps that precede actual output and publication into the printing apparatus, resulting in a truly integrated, digital press system. Pre-press editing functions can range from basic raster-image processing, which "screens" image data into halftone patterns and produces bitmaps from these patterns and from encoded text information (that specifies, for example, character fonts, scaling and orientation of the text), to full editing capability that allows an operator to enter information directly and manipulate it. Computer 40 performs these pre-press functions when unoccupied with imaging tasks; for example, since typical imaging rates are significantly slower than the maximum rate at which a suitable computer can operate, computer 40 can "multitask" imaging of one plate with pre-press operations for another plate.

After the plates have been imaged (or after off-press plate imaging and subsequent mounting of imaged plates to the plate cylinders), the press can be operated in its print mode to print proof copies of the original document, the number being determined by the operator's instructions entered via keyboard 48. If the colors printed on the copies are acceptable, the operator can instruct the press to print the required number of final copies. If changes are required, new printing plates can be made using appropriately corrected image data.

It is even feasible to make each plate cylinder house a plate-material cassette containing a length of imageable flexible mat or film that can be automatically advanced around the plate cylinder to locate fresh lengthwise segments of the mat or film on the cylinder surface. In this way, a plate with a satisfactory and properly registered image can be created very quickly and efficiently. The old image will be rolled up inside of the plate cylinder at the same time as the new material is dispensed.

4. Correction of Registration Errors

The press includes means for correcting various types of cyclical mechanical error, such as axial misalignment and skew. Our first registration-correction system operates during plate imaging. At this time, it is necessary to maintain angular coordination among plate cylinders so that similarly located image spots are applied at consistent circumferential positions on each cylinder. This requires coordination of each individual plate-imaging system both with its own plate cylinder (which holds the plate to be imaged) and with one another.

In our central-impression embodiment, such coordination takes place automatically, since the impression cylinder drives each plate cylinder, allowing the angular position of all plate cylinders to be determined by reference to the gear segments of the impression cylinder. For the in-line embodiment, it is necessary to establish the position on each plate where imaging is to begin, orient the writing head opposite this position, and maintain consistent spatial relationships between the writing heads and their associated plate cylinders, so that picture signals specifying particular image-spot positions will cause imaging of the same physical locations on each plate. We accomplish this by rotating each plate cylinder at substantially identical and consistent angular velocity, and including within each controller 30*a*, 30*b*, 30*c* and 30*d* an angular encoder (suitable designs for which are well-characterized in the art).

Computer 40, which is coupled to each of the controllers, receives the output of the associated angular encoders, and by appropriate control signals ensures consistent rotation and angular coordination among the plate cylinders. To establish consistent starting positions, as well as correct for registration errors caused by factors other than misalignment, computer 40 has access to a dot-position lookup table for each station (which may be included in CPU 44 or in each of controllers 30*a*, 30*b*, 30*c* and 30*d*). The lookup table stores the x and y coordinates of all dot positions of the picture to be imaged. By performing a so-called end-to-end test using plates imaged with simple test patterns (e.g. vertical and horizontal lines), copies are printed. If certain color lines deviate from the theoretical true position, the differences are measured and suitable x and y offsets entered into the lookup table at the locations therein corresponding to the offending dots of the particular color. This calibration step is performed only once at the factory during the final check-out phase of press manufacture, and the corrected dot positions for each color permanently stored in computer 40 or the respective controller as the pedigree for each of the print stations. Subsequent similar calibration is required only in the event that certain parts of the press, e.g. gearing or cylinders, had to be replaced.

FIG. 2 illustrates a two color print P printed by press station 30*c*, printing a cyan image $I_c$, for example, and by station 30*d*, printing a yellow image $I_y$, for example. Because plate cylinders 24*c* and 24*d* are out of phase with one another, the yellow image is displaced axially (x direction) and circumferentially (y direction) (i.e., it is out of register) with respect to the cyan iraq $I_c$ used as the position reference. Accordingly, it is necessary to bring the respective image-start positions into line with one another.

The yellow image is also skewed and is somewhat longer because, for example, plate cylinder 24*d* is slightly longer in diameter than plate cylinder 24*c*. Assuming that the images are scanned circumferentially as in FIG. 2, if plate cylinder 24*d* is even slightly larger in diameter then plate cylinder 24*c*, the image dots formed on the plate for the color yellow will be spaced further apart along a scan line than the corresponding dots on the cyan plate imaged at station 15*c*, thus making the yellow image longer than the cyan image.

Using corresponding targets on the different color images (e.g. image corners or crosshairs), the yellow image formed at station 30*d* can be brought into register with the reference cyan image formed at station 30*c* by introducing appropriate x and y offsets. Thus in FIG. 2, the distance between the vertical legs of the upper lefthand corners 1*c* and 1*y* of images $I_y$ and $I_c$ (or equivalent crosshairs) can be measured optically and an appropriate offset in the minus-x direction entered into CPU 44 using keyboard 48, so that controller 30*d* controls the writing head at imaging system 42*d* to start writing earlier, i.e. closer to its home position, in its travel along the plate cylinder 24*d*. Prints made from the corrected plate (i.e. prints similar to those shown in FIG. 2) are observed and the procedure repeated until the vertical legs of corners $1_y$ and $1_c$ coincide.

A similar procedure is used to achieve alignment in the y direction. In this case, the horizontal legs of corners 1*y* and 1*c* of the printed images $I_y$ and $I_c$ are compared and any needed offset (in this case, a plus-y offset) is entered into controller 14 via keyboard 48. Controller 30*d* then causes the writing head in imaging system 42*d* to start writing the yellow image earlier in the rotation of the plate cylinder at that station. As with the x-direction offset, corrected plates are imaged to make corrected prints P until the horizontal legs or corners 1*y* and 1*c* of the images $I_y$ and $I_c$ are in superposition.

If one image is longer than the other as depicted in FIG. 2, this will be apparent because the horizontal arms of the lower lefthand corners 2*y* and 2*c* (or equivalent targets) will not be in register. Correction is made by measuring the difference and entering an appropriate correction into computer 40, which issues appropriate signals to the relevant controller. Thus, to correct the excessive length of the image $I_y$ in FIG. 2, computer 40 enters a pulse-count offset into controller 30*d* to subtract one or more timing pulses from the counts that govern the firings of the associated writing head along each circumferential scan line. If it is necessary to add or delete more than one pulse, such additions or deletions are distributed uniformly along the scan line, and therefore generally occur only occasionally.

Skew errors due, for example, to cylinder taper may be corrected in more or less the same way by comparing the horizontal legs of the upper righthand corners 3y, 3c of images $I_y$ and $I_c$ and starting the scan lines progressively sooner or later relative to the phase angle of the plate cylinder. Thus, in the FIG. 2 example, the successive scan lines would be started progressively sooner to correct the skew between image $I_y$ and $I_c$.

After the above dot-position corrections or offsets have been entered into computer 40 (or directly into controllers 30a, 30b, 30c and 30d), the press contains the dot pattern of each plate cylinder in a lookup table such that the locations of all dot positions (i.e. timings of write signals to the writing heads) are known.

At the beginning of each scanning operation to write an image on a plate, the dot pattern may be downloaded to a circulating memory in each controller that circulates at the same rate that the plate cylinder is rotating. The writing heads are actuated or fired when the associated controller or computer 40 simultaneously supplies an image signal and a dot-position or write signal to the writing head. If there are fewer timing pulses between write signals, the head will fire nearer the beginning of the image signal resulting in an advanced firing of the head relative to the norm; if there are more timing signals between the write signals, the head will fire nearer the end of the image signal resulting in a delayed firing of the head.

If the press is to print web material, it is possible to introduce other means for coordinating the action of the print stations with respect to the recording material to maintain print registration thereon. For example, it is possible to increase or retard the rate at which the plate cylinders rotate, thereby altering each cylinder's relative impression phase. Alternatively, the print stations themselves can be mounted on slide tracks that permits the distances between them to be adjusted, or the web-transport system can be configured to allow alteration of the length of travel among print stations. Either approach facilitates gross or fine adjustment of the time between successive impressions, thereby altering the relative phases of these impressions, and can be controlled using the dot-lookup approach just discussed.

5. Ink Regulation and Control

The operator can also regulate ink flow at each print station using keyboard 48 in the event this is deemed advisable from examination of the images on the printed copies in the course of a printing run. Furthermore, CPU 44 can be programmed to automatically control the ink-adjustment regulators (e.g., screws or keys) along each ink-fountain doctor blade to set the screws or keys in accordance with the amount of ink required across the image, based on a count of the number of dots of each color to be printed in the band controlled by each adjusting screw or key.

If desired, the printed copies may include color bars printed in margins outside the desired image areas, which margins are trimmed away after the prints are made. Such a color bar is illustrated at 108 in the bottom margin of the print 102 in FIG. 2. The color bar is normally composed of a string of color blocks, e.g., cyan (c), yellow (y), magenta (m) and black (b), showing the colors printed by each print station across the entire width of the press. Actually, the bar 108 in the two-color print shown in FIG. 6 would have only cyan (c) and yellow (y) blocks. The bar may also include blocks with geometric patterns indicative of color grade, resolution, etc.

As discussed above and in the aforementioned U.S. Pat. No. 4,058,058, typically, press 10 may have a number of electrically controlled ink-regulating screws or keys distributed across the press to regulate the amount of ink that the ink fountain at each print station applies to the plate cylinder at that station. FIG. 2 shows a set of six such keys juxtaposed to print 102 at print station 15c for regulating cyan ink. In actual practice, a typical press would have more keys at each station, e.g., a press eighteen inches wide may have sixteen ink keys at each station 15a to 15d. Computer 40 determines for each print station which scan lines of the plate are associated with each ink key, e.g., lines 1–100=key 1; lines 101–200=key 2, etc. If the print is narrow, some keys may be unused.

Computer 40 then determines the number of image dots associated with each key and calculates the percent of coverage for that key, defined as the total dot count per ink key divided by the maximum dot count per key; the latter quantity represented the total number of dots that could be inked by a given ink key if all dots in all the scan lines assigned to the ink key were to be printed. Computer 40 next converts this percentage to a key setting and appropriately controls the key solenoid to achieve that setting. If an examination of the images I or color bars 108 printed on the copies indicates that a color correction is warranted at any ink key location, this correction may be made via keyboard 48.

Optionally, by the addition of a densitometer, it is possible to achieve a fully automatic closed-loop color adjusting system. The initial settings of the ink-regulating screws or keys 106 may be based on a dot count done by computer 40 as previously described. Using an "on the fly" flash color densitometer, the various colors (within the color bar 108) can be scanned, and the results fed back to CPU 44. CPU 44 then compares the densitometer readings to the original dot-count analysis, and makes new key adjustments if needed. CPU 44 may also be programmed to correlate, over time, densitometer readings with color-correction levels. This facilitates "adaptive learning" of optimal correction levels for different ink coverages, which can be directly implemented by computer 40 without the need for constant operator attention. Preferably, computer 40 is also programmed to permit manual override of the selected color-correction levels.

Such a densitometer, shown at 110 in FIG. 2, may be mounted at the exit end of the press so that it can be positioned at selected locations across the width of the press, e.g., using a servo-controlled lead screw, corresponding to the locations of the color blocks comprising the color bar 108. The densitometer is operated to flash at the moment that the color bar 108 is under the densitometer. In this way, the instrument can take readings of the amounts of color in the color blocks of bar 108. The solid density of each color is maintained at the required densitometer level. If the instrument 110 reading is low in a particular color, the appropriate ink key at the corresponding print station is opened slightly to correct the error; if a reading is high, the offending key is closed by the required amount to restore the correct densitometer reading.

These steps can be repeated as many times as required.

Once the process is completed, the data (for each print station) can be stored as the pedigree of each color station. This color pedigree or fingerprint can then be used for the setup of the next printing job. Using this approach, each successive job should come closer to final settings from the outset.

Computer 40 can also be programmed to automatically control the other usual press operations such as start up, shut down and clean-up.

It will thus be seen that the objects set forth above, among those made apparent from the preceding description, are efficiently attained and, since certain changes may be made in carrying out the above method and in the construction set forth without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention described herein.

What is claimed as new and desired to be secured by Letters Patent of the United State is:

1. Printing apparatus comprising:

a. a plate cylinder and a printing plate having a printing surface and including a metal first layer and a second layer underlying said first layer, said first and second layers having different affinities for a printing liquid selected from the group consisting of water and ink;

b. a discharge source spaced close to said printing surface;

c. means for mounting said plate to the plate cylinder;

d. means for exposing the printing surface to spatial spark discharges between said plate and the discharge source, said discharges being of sufficient strength to remove said metal first layer and expose said second layer at selected points on the plate;

e. means for moving the discharge source and plate cylinder relatively to effect a scan of the printing surface by the discharge source; and f. means for controlling the discharges in accordance with electronic signals representing an image so that they occur at selected times in the scan, thereby directly producing on the plate an array of image spots which can be inked to make copies of the image represented by the electronic signals.

2. The apparatus defined in claim 1 wherein the spark discharges carry current of at least 0.1 amp.

3. The apparatus defined in claim 1 wherein the potential of the spark discharges exceeds 2000 volts.

4. The apparatus defined in claim 3 wherein the potential is established by applying a positive voltage to the discharge source relative to the plate.

5. The apparatus defined in claim 3 wherein the potential is established by applying a negative voltage to the discharge source relative to the plate.

6. The apparatus defined in claim 1 wherein the potential of the spark discharge is sufficient to cause substantially straight-line travel of said spark from said discharge source to said printing surface.

7. The apparatus defined in claim 1 and further comprising means for varying a characteristic selected from the group consisting of voltage, current, time duration and number of said spark discharges for varying the sizes of the spots produced by said discharges.

8. Apparatus for imaging a lithographic plate, said apparatus comprising:

a. a lithographic plate having a printing surface and including a metal layer and a second layer underlying said metal layer, said metal and second layers having different affinities for a printing liquid selected from the group consisting of water and ink, and means for supporting said lithographic plate:

b. at least one spark-discharge source, each of which includes a writing head comprising an electrode;

c. means for positioning the source close to the printing surface; and d. means for delivering high-voltage pulses in excess of 2000 volts to each electrode to produce spark discharges substantially perpendicular to the printing surface without contacting the printing surface with the spark-discharge source, said discharges being of sufficient strength to remove said metal layer and expose said second layer at selected points, thereby changing the affinity of said printing surface for said liquid at said points.

9. The apparatus defined in claim 8 wherein the spark discharges carry current of at least 0.1 amp.

10. The apparatus defined in claim 8 wherein the potential is established by applying a positive voltage to the electrode relative to the plate.

11. The apparatus defined in claim 8 wherein the potential is established by applying a negative voltage to the electrode relative to the plate.

12. The apparatus defined in claim 8 wherein the potential of the spark discharge is sufficient to cause substantially straight-line travel of said spark from said electrode to said printing surface.

13. The apparatus defined in claim 8 and further comprising means for varying a characteristic selected from the group consisting of voltage, current, time duration and number of said spark discharges for varying the sizes of the spots produced by said discharges.

14. A method of imaging on a press including a plate cylinder for supporting a printing plate, said method comprising the steps of:

a. providing a printing plate having a printing surface and comprising a metal first layer and a second layer underlying said first layer, said first and second layers having different affinities for a printing liquid selected from the group consisting of water and ink;

b. mounting said plate to the plate cylinder;

c. without contacting said printing surface, exposing the printing surface to spark discharges between said plate and a discharge source spaced close to said printing surface at selected points thereon, said discharges being of sufficient strength to remove said metal first layer and expose said second layer at the selected points on the plate;

d. moving the discharge source and the print cylinder relatively to effect a scan of the printing surface by the discharge source; and e. controlling the discharges in accordance with electronic signals representing an image so that they occur at selected times in the scan, thereby directly producing on the plate an array of image spots which can be inked to make copies of the image represented by the electronic signals.

15. The method defined in claim 14 wherein the spark discharges carry current of at least 0.1 amp.

16. The method defined in claim 14 wherein the potential of the spark discharges exceeds 2000 volts.

17. The method defined in claim 16 wherein the potential is established by applying a positive voltage to the discharge source relative to the plate.

18. The method defined in claim 16 wherein the potential is established by applying a negative voltage to the discharge source relative to the plate.

19. The method defined in claim 14 wherein the potential of the spark discharge is sufficient to cause substantially straight-line travel of said spark from said discharge source to said printing surface.

20. The method defined in claim 14 and further comprising the step of varying a characteristic selected from the group consisting of voltage, current, time duration and number of said spark discharges for varying the sizes of the spots produced by said discharges.

21. A method of imaging a printing plate, said method comprising the steps of:

a. providing a printing plate having a printing surface and comprising a metal layer and a second layer underlying said metal layer, said metal and second layers having different affinities for a printing liquid selected from the group consisting of water and ink;

b. spacing from the printing surface at least one spark-discharge source, each of which includes a writing head comprising an electrode, each writing head being oriented opposite the printing surface; and c. delivering high-voltage pulses in excess of 200 volts to each electrode to produce spark discharges substantially perpendicular to the printing surface without contacting the printing surface with the writing head, said discharges being of sufficient strength to remove said metal layer and expose said second layer at selected points, thereby changing the affinity of said printing surface for said liquid at said points.

22. The method defined in claim 21 wherein the spark discharges carry current of at least 0.1 amp.

23. The method defined in claim 21 wherein the potential difference is established by applying a positive voltage to the electrode relative to the plate.

24. The method defined in claim 21 wherein the potential difference is established by applying a negative voltage to the electrode relative to the plate.

25. The method defined in claim 21 wherein the potential difference is sufficient to cause substantially straight-line travel of said spark discharge from said writing head to said printing surface.

26. The method defined in claim 21 and including the additional step of varying a characteristic selected from the group consisting of voltage, current, time duration and number of said discharges for varying the sizes of the spots produced by said discharges.

* * * * *